US008006607B2

(12) United States Patent
Wickert et al.

(10) Patent No.: US 8,006,607 B2
(45) Date of Patent: Aug. 30, 2011

(54) PROTECTIVE MODULE USING ELECTRIC CURRENT TO PROTECT OBJECTS AGAINST THREATS, ESPECIALLY FROM SHAPED CHARGES

(75) Inventors: Matthias Wickert, Freiburg (DE); Karsten Michael, Bad Bellingen (DE); Jürgen Kuder, Albbruck (DE)

(73) Assignee: Fraunhofer-Gesellschaft zur Förderung der angewandten Forschung e.V., München (DE)

( * ) Notice: Subject to any disclaimer, the term of this patent is extended or adjusted under 35 U.S.C. 154(b) by 616 days.

(21) Appl. No.: 11/913,415

(22) PCT Filed: May 4, 2006

(86) PCT No.: PCT/EP2006/004207

§ 371 (c)(1),
(2), (4) Date: Jul. 15, 2008

(87) PCT Pub. No.: WO2006/117232

PCT Pub. Date: Nov. 9, 2006

(65) Prior Publication Data

US 2009/0199701 A1 Aug. 13, 2009

(30) Foreign Application Priority Data

May 4, 2005 (DE) ..... 10 2005 021 348

(51) Int. Cl.
*F41H 11/00* (2006.01)

(52) U.S. Cl. ..... 89/36.17; 89/36.01; 89/902; 109/36; 109/34

(58) Field of Classification Search ..... 89/36.01–36.17; 109/34, 36
See application file for complete search history.

(56) References Cited

U.S. PATENT DOCUMENTS

| | | | | |
|---|---|---|---|---|
| 6,622,608 | B1 | 9/2003 | Faul et al. | |
| 6,698,331 | B1 * | 3/2004 | Yu et al. | 89/36.02 |
| 6,899,009 | B2 * | 5/2005 | Christiansen et al. | 89/36.02 |
| 7,465,500 | B2 * | 12/2008 | Yang et al. | 428/550 |
| 7,661,350 | B2 * | 2/2010 | Bouet | 89/36.02 |
| 2004/0118273 | A1 * | 6/2004 | Zank | 89/36.17 |
| 2007/0240621 | A1 * | 10/2007 | Qiao | 109/26 |

FOREIGN PATENT DOCUMENTS

| | | | |
|---|---|---|---|
| DE | 31 32 007 | C1 | 8/1981 |
| DE | 31 29 774 | C1 | 10/1981 |
| DE | 34 04 272 | A1 | 2/1984 |
| DE | 37 05 694 | C2 | 2/1987 |
| DE | 37 15 807 | C1 | 5/1987 |
| DE | 40 34 401 | A1 | 4/1992 |
| DE | 42 44 546 | C2 | 5/1998 |
| RU | 2 064 651 | C1 | 7/1996 |
| RU | 2 148 237 | C1 | 4/2000 |
| SE | 522 191 | C2 | 1/2004 |
| WO | WO 2004/057262 | A2 | 7/2004 |

* cited by examiner

*Primary Examiner* — Michael Carone
*Assistant Examiner* — Samir Abdosh
(74) *Attorney, Agent, or Firm* — Antonelli, Terry, Stout & Kraus, LLP.

(57) ABSTRACT

A device is disclosed for protecting an object from shaped charge jets comprising an electrode arrangement which is provided with at least one electrode facing the object and one electrode facing away from the object between which an electrical voltage can be applied. The invention is distinguished by the object-facing electrode having at least one area with a spatially heterogeneous electrode material.

19 Claims, 1 Drawing Sheet

PROTECTIVE MODULE USING ELECTRIC CURRENT TO PROTECT OBJECTS AGAINST THREATS, ESPECIALLY FROM SHAPED CHARGES

BACKGROUND OF THE INVENTION

1. Field of the Invention

The present invention relates to a protective module using electric current to protect objects against threats, especially from shaped charges.

2. Description of the Prior Art

Various protective mechanisms are already in use to protect objects, for example combat tanks, from shaped charges. One protective mechanism provides for using electric current to disturb shaped charge jets. A basic principle of this electric protective mechanism is coupling an electric current into the jet generated by the shaped charge with the aid of two electrode plates, which then results in disturbing the jet.

Shaped charge jets are generated with the detonation of an arrangement of highly explosive substances about a conic or hemispherical intermediate metal ply and are especially suited for penetrating armor. Such type shaped charge jets are distinguished by a unidirectional aimed material jet developing in the course of the detonation. At its tip, the shaped charge jet has velocities in the range from about 7 km/s to 10 km/s. If such a shaped charge jet encounters an obstacle, such as for example armor, due to the jet pressure occurring with the great jet velocity, the material of the armor behaves in the magnitude of several hundred GPa, like fluids, in such a manner that the shaped charge jet penetrates layered materials in accordance with the laws of hydrodynamics, which explains the penetration force of these shaped charge jets.

Just as there are efforts to optimize the penetration force of such type shaped charge jets, there are also efforts to design suitable protection mechanisms, such as for example armor, to minimize the destructive effect of the shaped charge jet on the objects as much as possible. The further description, therefore, relates to protecting objects from the effect of shaped charge jets.

S. V. Demidkov's article "The Ways of the Shaped Charge Jets Functional Parameters Electromagnetic Control Efficiency Amplification", 20$^{th}$ International Symposium on Ballistics, FL, 23-27 Sep. 2002, explains the effect of electromagnetic fields on the propagation of shaped charge jets. This article describes the state-of-the-art protection principle based on selective widening of a shaped charge jet by coupling in electric current along the propagating shaped charge jet. A capacitor-like electrode arrangement provided with two electrode plates which are spaced apart and placed before the to-be-protected object is used. FIG. 2 shows a schematic representation of such a type arrangement. The shaped charge 1 penetrates from above the electrically charged electrode plates 2 and 3, which are connected to a pulsed-current source 4 of current pulse designed as a high-voltage capacitor. At least one electrode 2 faces away from the object 5 and at least one electrode 3 faces the object 5. The at least one electrode 2 facing away from the object 5 is impacted by the shaped charge jet 1 before the at least one electrode 3 facing the object. The connections of the source 4 of a current pulse are connected to the electrode plates 2 and 3, which are penetrated by the shaped charge jet 1 in the illustrated manner. Described is that when the shaped charge jet 1 penetrates through the two electrode plates 2 and 3, an electric current developing along the jet causes the shaped charge jet 1 to disturb the jet, so that after the shaped charge jet 1 has penetrated through the electrode plate 3 facing the object, the diameter of the jet widens thereby reducing the penetration power of the jet inside the object 5. The penetration power of the jet inside the object 5 can be determined by the penetration depth of the shaped charge jet into the object.

Fundamentally an electric current can only occur along the shaped charge jet as soon as the tip of the shaped charge jet 1 hits the electrode 3 facing the object 5, producing in this manner a conducting connection between the two electrodes 2 and 3. As the shaped charge jet 1 has good electrical conductivity, a high current of several 100 kA flows between the electrode plates upon passage of the shaped charge jet through the two electrodes. However, the electric current along the jet 1 can only flow through a section of the shaped charge jet located between the electrodes as long as this section of the jet is situated between the electrode plates and has not yet exited from the rear electrode. In order to do this, the pulsed-current input 4 has to be adapted to the passage time of the shaped charge jet 1, for example in such a manner that the current flow runs in the form of a cushioned vibration and the duration of the first halfwave is attuned to the duration of the passage of the shaped charge jet. As previously mentioned, the tip of the shaped charge jet is able to propagate with a very great velocity of 7 km/s or more and thus pass the two electrode plates, which are disposed some centimeters apart, within a few microseconds. For this reason, especially the time span of coupling-in the current into the tip of the shaped charge jet is very short and consequently also the possibility of widening the cross section of the jet, as the current is only able to rise at a limited rate of change which is essentially dependent on the inductivity of the circuit.

If, as shown in example FIG. 2, plates composed of full material, for example steel, are used as the electrodes, due to the only limited thickness of the electrode plates, electric current only flows very briefly through the tip of the shaped charge jet as the electric current does not start flowing until that the tip of the jet reaches the electrode 3 facing the object 5.

However, if the tip of the jet exits immediately from the rear electrode plate 3, electrical current can no longer flow through the intermediate space between the electrodes during the whole passage period as it does through the middle region of the shaped charge jet 1. Thus there is presently no adequate way to disturb the shaped charge jet with state-of-the art means of effective protection from shaped charge jets.

DE 40 34 401 A1 describes a generic electromagnetic armor with two plates which are placed at a distance from each other and which are connected in parallel and are electrically chargeable with at least one capacitor.

WO 2004/057262 A2 describes a multiple-plate armor which has at least one plate composed of electrostrictive or magnetostrictive material.

U.S. Pat. No. 6,622,608 describes a plate armor which has at least two distance-variable plates whose distance from each other is adjustable as required by means of electromagnetic repelling forces between the plates.

Finally, DE 42 44 564 C2 describes a protective element with a sandwich-like designed structure which is provided with a coil and/or capacitor arrangement by means of which the adjacent protective plates can be accelerated to reduce the depth of penetration into the structure of an approaching shaped charged projectile.

SUMMARY OF THE INVENTION

The present invention is a device for protecting an object against shaped charge jets comprising an electrode arrangement provided with at least one electrode facing the object and at least one electrode facing away from the object, between which electrodes an electrical voltage can be applied in such a manner that distinct improvement of the disintegration effect on the shaped charge jet is possible, comparable to a wire explosion. The measures required for this should fulfill the aspect of simple technological and cost-effective realization and, in particular, are realizable with as light a weight as possible.

According to the invention, a device for protecting an object against shaped charge jets comprising an electrode arrangement is distinguished by the electrode facing the object having at least one area with a spatially heterogeneous electrode material, which is preferably of less material density compared to steel, due to which it is possible to select a considerably greater thickness for the object-facing electrode compared to an object-facing electrode which is designed as a steel plate without the normally ensuing increase in weight of the device according to the invention.

Just as in the case of all state-of-the art electrode arrangements, the electrode material should have very good electrical conductivity to ensure that as the jet passes through both opposite electrodes a marked electrical flow of current develops along the shaped charge jet.

A light metal foam, for example an open-pore aluminum foam with a relative density of 6% compared to the density of an electrode composed of full aluminum material, proves to be especially advantageous for the electrode facing the object. The above-described aluminum foam is distinguished by corresponding inclusions of air and high porosity. Moreover, also feasible, however, are electrodes which have a heterogeneous structure produced by means of chemical, mechanical and/or physical material processing methods capable of conveying a great electrical current to the point of penetration of the shaped charge jet. Such a type of structure could, for example, have a honeycomb structure. Suited for material processing to provide possible electrode structures are in particular chemical or physical precipitation or deposition processes. However, also suitable are chemical or physical material-removal processes, such as for example chemical etching or abrasive-acting material removal, However, it is also possible to produce an electrode from an ordered or an unordered mesh composed of at least one electrically conducting, wirelike conducting material. For example, the design of an electrode in the form of a wire mesh made of copper would be a preferred implementable electrode form. Of course, it is just as possible to design the electrode facing the object multilayered, for example with various electrode regions of different porosity and structure.

Apart from the reduced density of the heterogeneous region of the electrode facing the object, the region hit by the shaped charge jet reacts, contrary to full material such as steel, with great displacement of the heterogeneous electrode material away from the axis of the jet. The result is that the distance of the stationary heterogeneous electrode material in the radial direction from the axis of the jet—increases while the tip of the shaped charge jet penetrates further into the heterogeneous region of the electrode material, with a forming of a forward moving crater bottom. The tip of the jet develops in the region of the crater bottom a good electrical contact via which a high current can be coupled into the shaped charge jet. The coupled current at the crater bottom is able to contribute to disturbing the entire jet cross section from the tip of the shaped charge jet to the first electrode 2. At the same time, due to the great distance of the shaped charge jet from the material pushed aside by the passage of the jet tip, it is to be expected that coupling of current in jet regions behind the tip is reduced, thereby decreasing current paths that do not contribute to disintegration of the shaped charge jet to the tip of the jet.

In contrast to this, with a full material a solid crater wall forms which is only a small distance from the shaped charge jet thereby facilitating coupling in current behind the tip. The respective current paths no longer lead via the tip of the shaped charge jet thus detracting from effective disturbance of the jet tip.

It was demonstrated that the structure of the electrode material according to the invention using the aforedescribed material variants permits effectively influencing the tip of the shaped charge jet due to the material-based crater formation and the current paths developing therein.

Moreover, especially advantageous is inserting between the two electrodes a plate, referred to hereinafter as stripper plate, composed of an electrically insulating material. The stripper plate is preferably penetrated with a very small crater diameter, while after penetration of the first electrode metal particles and a sheath of ionized particles about the actual shaped charge jet are held back as far as possible. In this manner, parasitic current paths, running in the vicinity of the shaped charge jet but not through it and thus not contributing to disturbing the shaped charge jet, of the current flowing in the shaped charge jet are reduced between the two electrodes. The current flow is thus concentrated on to the "stripped" shaped charge jet.

BRIEF DESCRIPTION OF THE DRAWINGS

The present invention is made more apparent in the following using preferred embodiments with reference to the accompanying figures without the intention of limiting the scope or spirit of the overall invention.

DETAILED DESCRIPTION OF THE INVENTION

Figure 1:
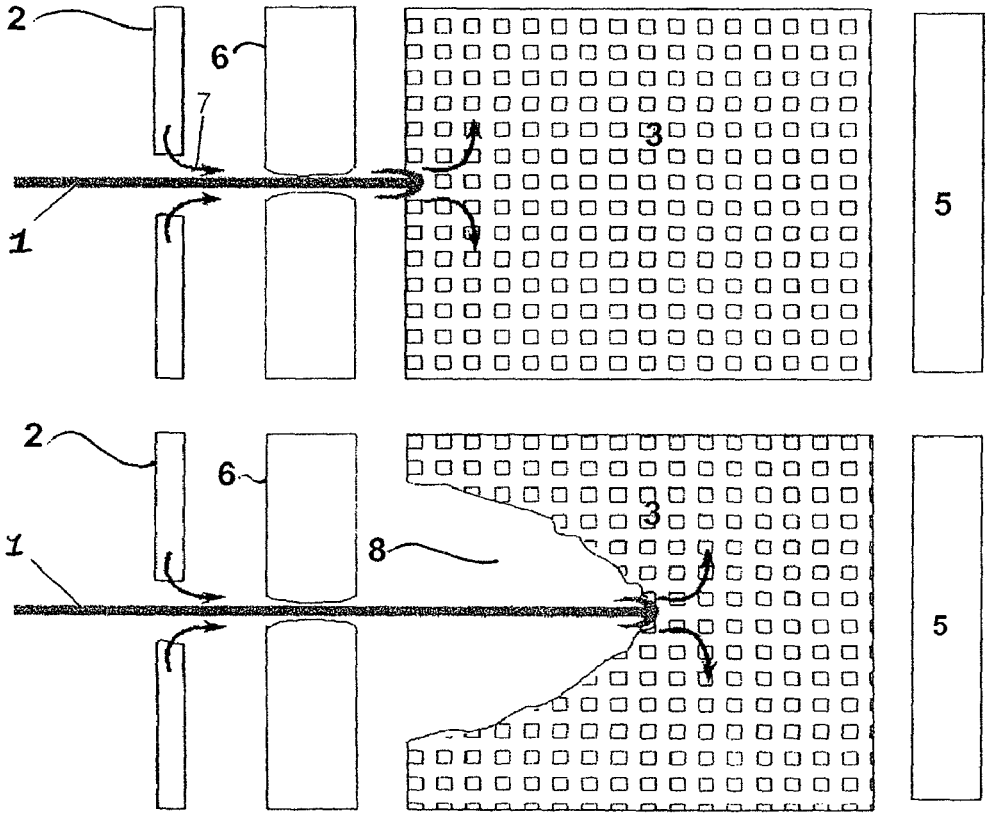
FIG. 1 shows a schematic representation of a protective arrangement designed according to the solution.

FIG. 1 shows a schematic principle representation of the arrangement designed according to the invention for protection from shaped charge jets. The two picture sequences depicted in FIG. 1 each show a shaped charge jet 1 penetrating a front electrode 2 facing away from the object 5 from the left and then propagating to the right. In the jet direction of the shaped charge jet 1, a stripper plate 6 made of an electrically insulating material, which can for example be made of polypropylene, is placed downstream of the electrode 2. Moreover, an electrode facing the object, a so-called rear electrode 3 is provided which in the depicted preferred embodiment is designed to be porous and encloses single cavities as the multiplicity of small boxes principally indicates. The upper sequential representation in FIG. 1 shows the moment in time when the shaped charge jet 1 contacts the rear electrode 3 and in this manner produces an electrical contact between the front electrode 2 and the rear electrode 3. Furthermore, it is assumed that the two electrodes 2 and 3 are connected via a pulsed-current source, not depicted in FIG. 1, preferably in the form of a high-voltage capacitor like the arrangement depicted in FIG. 2, with the electrical voltage applied between the two electrodes being at least several kV.

An insulating stripper plate 6 is provided between the two electrodes 2 and 3. The stripper plate 6 suppresses parasitic current paths, ensuring that a current flow between the two electrodes 2 and 3 occurs solely through and along the shaped charge jet 1.

Figure 2:
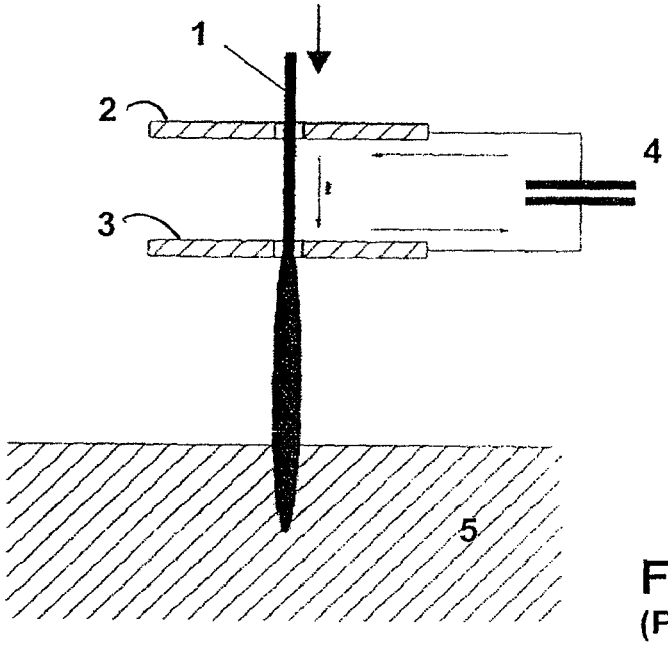
Fig. 2 (Prior Art)
FIG. 2 shows a protective arrangement according to the state of the art.

In contrast to an electrode composed of full material as for example briefly described for the state of the art with reference to FIG. 2, due to the porous or otherwise structured design of the rear electrode 3, the tip of the shaped charge jet 1 interacts with the rear electrode 3 in such a manner that distinct lateral crater formation 8 occurs inside the rear electrode 3 when the shaped charge jet 1 penetrates through the rear electrode 3. Present reflections assume that, due to this strong lateral crater formation 8, coupling of the current into the jet in the region of the tip of the shaped charge jet 1 is concentrated at the bottom of the crater so that the current-coupling site moves with the crater bottom through the heterogeneous region of electrode 3. As a consequence, it is possible to extend coupling of the electric current through the jet tip. This may be referred to as a dynamic electrode. At the edge of the electrode, the crater bottom is effective for coupling the current moving along with the tip of the shaped charge jet. In this manner, the duration of the coupling of current into the tip of the shaped charge jet is influenced by the length of the possible path through the heterogeneous region of the electrode material. The result is an extension of the coupling of current through the tip of the shaped charge jet due to which strong disintegration of the shaped charge jet can be achieved as in a wire explosion so that the penetration effect on the object 5 downstream in the jet direction of the rear electrode 3 caused by the shaped charge jet is considerably reduced.

Although the electrode thickness of the rear electrode 3 is greater, the weight of the electrode arrangement is not necessarily greater compared to conventional electrode plates made of steel in view of the rear electrode 3 being composed of porous material with air inclusions, whose specific weight is considerably less than that of an electrode composed of full material.

Porous material or structured electrode materials with enclosed cavities in the diameter of the shaped charge jet of up to several millimeters have proved especially advantageous, which permits effective disturbance of the shaped charge jet and contributes to less armor weight.

Tests with a preferred embodiment have clearly demonstrated the effectiveness of the protective arrangement. The preferred embodiment has an aluminum front plate 2 functioning as the electrode facing away from the object with a thickness of 6 mm. An insulating stripper plate 6 is placed at a distance of 15 mm from the front plate which is an insulating stripper plate, composed of polypropylene, with a thickness of 15 mm. Downstream opposite the stripper plate 6 is placed the object-facing electrode 3 composed of a 120 mm thick aluminum foam electrode whose relative density was 6% compared to full material. The electrode 3 composed of aluminum foam is integrally cast to a 10 mm thick aluminum base which is attached to a 6 mm thick aluminum plate providing good electrical contact. The integrally cast aluminum base ensured good electrical connection to the net-like aluminum foam structure. The back most plate serves to supply current and to support the structure.

A voltage of 10 kV was applied between the electrodes with the aid of a high-voltage capacitor. It was possible to demonstrate that when shooting at the preceding electrode arrangement with a shaped charge jet, no significant parts of the shaped charge jet were able to penetrate the back most aluminum plate in the jet direction. In this preferred embodiment, this plate is not currently designed to intercept entrained fragments and does not currently stopp bolts of the shaped charge. With the same test setup, but without application of high voltage between the two electrodes, the shaped charge jet applied to the electrode arrangement was able to penetrate the setup practically unimpeded. Thus it was possible to demonstrate that the protective effect against shaped charge jets depends decisively and unequivocally on the coupling of electrical current, which the electrode arrangement of the invention was able to distinctly improve.

LIST OF REFERENCES

1. shaped charge jet
2. electrode facing away from the object, front electrode
3. electrode facing the object, rear electrode
4. pulsed current source, high-voltage capacitor
5. object
6. stripper plate
7 entrained electrode particles
8. crater formation

What is claimed is:

1. A device for protecting an object from impact of a shaped charge jet comprising:

an electrode arrangement, for connection to a source of a current pulse, including at least one electrode facing away from the object and at least one electrode facing the object wherein the at least one electrode facing away from the object is impacted by the shaped charge jet before the at least one electrode facing the object and an electrical voltage is applied during the impact from the source of a current pulse between the at least one electrode facing away from the object and the at least one electrode facing the object; and wherein the at least one electrode facing the object includes at least one area with a spatially heterogeneous electrode material and the source of a current pulse applied during the impact is connected to the at least one electrode facing the object and to the at least one electrode facing away from the object to provide the electrical voltage therebetween.

2. A device according to claim 1, wherein:

the spatially heterogeneous electrode material includes an electrically conducting metal foam.

3. A device according to claim 2, wherein:

the metal foam is an open-pore aluminum foam which has a relative density of less than 10% of the density of aluminum.

4. A device according to claim 1, wherein:

the spatially heterogeneous electrode material comprises a structured electrode material produced by at least one chemical, mechanical and/or physical material processing method and the spatially heterogeneous electrode material comprises local cavities.

5. A device according to claim 4, wherein:

the structured electrode material is a honeycomb structure.

6. A device according to claim 4, wherein:

the local cavities comprise a material filling with a relative density less than the structured electrode material surrounding the material filling.

7. A device according to claim 5, wherein:

the local cavities comprise a material filling with a relative density less than the structured electrode material surrounding the material filling.

8. A device according to claim 6, wherein:

the material filling is steel wool.

9. A device according to claim 7, wherein:

the material filling is steel wool.

10. A device according to claim 1, wherein:

the spatially heterogeneous electrode material is an ordered or an unordered mesh, including at least one electrically conducting material.

11. A device according to claim 10, wherein:

the at least one electrically conducting material is steel wool.

12. A device according to claim 1, comprising:

an electrically insulating material disposed between the at least one electrode facing the object and the at least one electrode facing away from the object.

13. A device according to claim 12, wherein:

the insulating material comprises a plate.

14. A device according to claim 1, wherein:

the source of the current pulse is a computer.

15. A device according to claim 1, wherein:

the electrode facing the object has a density less than steel.

16. A device according to claim 2, wherein:

the source of a current pulse is connected to the at least one electrode facing the object and to the at least one electrode facing away from the object to provide the electrical voltage therebetween.

17. A device according to claim 16, wherein:

the source of the current pulse is a computer.

18. A device according to claim 1, wherein:

the source of a current pulse is a charged capacitor.

19. A device according to claim 16, wherein:

the source of a current pulse is a charged capacitor.

* * * * *